US005474970A

United States Patent [19]

Defieuw et al.

[11] Patent Number: 5,474,970

[45] Date of Patent: Dec. 12, 1995

[54] DYE-DONOR ELEMENT FOR USE IN A THERMAL DYE TRANSFER PROCESS

[75] Inventors: Geert Defieuw, Kessel-Lo; Emiel Verdonck, Berlaar; Luc Van Steen, Antwerp, all of Belgium

[73] Assignee: Agfa-Gevaert N.V., Mortsel, Belgium

[21] Appl. No.: 267,467

[22] Filed: Jun. 28, 1994

[30] Foreign Application Priority Data

Jul. 12, 1993 [EP] European Pat. Off. ..... 93202050

[51] Int. Cl.[6] ..... B41M 5/035; B41M 5/38

[52] U.S. Cl. ..... 503/227; 428/195; 428/206; 428/323; 428/412; 428/447; 428/913; 428/914

[58] Field of Search ..... 428/195, 206, 428/207, 488.4, 447, 913, 914, 323, 412; 8/471; 503/227

[56] References Cited

U.S. PATENT DOCUMENTS 4,572,860 2/1986 Nakamura et al. .

4,684,561 8/1987 Imai et al. ..... 428/141

4,925,735 5/1990 Koshizuka et al. ..... 428/423.1

4,950,641 8/1990 Hann et al. ..... 503/227

FOREIGN PATENT DOCUMENTS 0407220 1/1991 European Pat. Off. ..... 503/227

0527520 2/1993 European Pat. Off. ..... 503/227

*Primary Examiner*—B. Hamilton Hess

*Attorney, Agent, or Firm*—Brumbaugh, Graves, Donohue & Raymond

[57] ABSTRACT

The present invention provides a dye-donor element for use according to thermal dye transfer methods comprising a support having on the front side a dye layer containing a thermally transferable dye and on the back side (i) a heat-resistant layer comprising a binder and (ii) optionally a topcoat layer, said heat-resistant layer and/or said topcoat layer comprising a polysiloxane based lubricant and wherein at least one layer on said back side comprises a salt of a fatty acid.

13 Claims, 1 Drawing Sheet

DYE-DONOR ELEMENT FOR USE IN A THERMAL DYE TRANSFER PROCESS

FIELD OF THE INVENTION

The present invention relates to dye-donor elements for use according to thermal dye sublimation transfer and in particular to a heat-resistant layer of said dye-donor elements.

BACKGROUND OF THE INVENTION

Thermal dye sublimation transfer also called thermal dye diffusion transfer is a recording method in which a dye-donor element provided with a dye layer containing sublimable dye having heat transferability is brought into contact with a receiver sheet and selectively, in accordance with a pattern information signal, is heated by means of a thermal printing head provided with a plurality of juxtaposed heat-generating elements or resistors, so that dye is transferred from the selectively heated regions of the dye-donor element to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which has been covered with a dye layer comprising the printing dyes. Usually, an adhesive or subbing layer is provided between the support and the dye layer.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the dye-donor element past the thermal printing head. An adhesive layer may be provided between the support and the heat-resistant layer.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 02/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the dye-receiving element is required in order to obtain a good density uniformity all over the print. However, when white lines in a flat field of high density are printed parallel to the line of heater elements, the drum transport is hindered and the white line is further elongated up to the edges of the printed image.

This phenomenon occurs in particular when the average printing power of said heat-generating elements exceeds 4.5 $W/mm^2$. The average printing power is calculated as the total amount of energy applied during one line time divided by the line time and by the surface area of the heat-generating elements. Conventional thermal printers usually operate with a maximum average printing power of 3 to 4.5 $W/mm^2$. However, to obtain increased print densities and/or faster printing speeds, it is desirable to use an average printing power larger than 4.5 $W/nmL^2$.

These high printing energies are used in thermal sublimation printers, which for the sublimation (or diffusion) of dye require substantially higher printing energies than thermal wax printers, in which delamination and fusion of the dye later are caused.

It has been suggested to use different types of lubricants to allow continuous transport of the dye-donor ribbon relative to the thermal head.

In EP 153,880 and EP 194,106, phosphoric acid derivatives are used as slipping agents. However, these products give corrosion problems due to the high acidity content. Moreover, these slipping agents hydrolyse the binders of the heat-resistant layer during the coating procedure, storage of the donor ribbon and/or printing procedure.

It has been suggested to neutralise these phosphoric acid derivatives with potassium or sodium hydroxide. However, it is well known that potassium and sodium ions interfere with electronic components such as thermal heads (especially at higher temperatures).

Other well known lubricants are polysiloxanes such as those mentioned in EP 267,469, EP 138,483, U.S. Pat. Nos. 4,738,950, 4,866,028, 4,753 920 and U.S. Pat. No. 4,782,041. Especially useful slipping agents are polysiloxane-polyether block or graft polymers. Although, the above lubricants perform well at constant printing density they give rise to white lines.

Metal salts of long fatty acids are also well-known lubricants (such as mentioned in EP 458,538, EP 458,522, EP 314,348, JN 01/241,491 and JN 01/222,993). White lines are observed, however, when high printing energies are applied.

It has been suggested to use lubricating polymers such as polyethylene waxes or lubricating waxes such as amide or ester waxes in combination with a polysiloxane lubricant in order to prevent this phenomenon.

However, the use of polyethylene waxes in the heat-resistant layer results in a contamination of the thermal head when multiple printing is performed. Low molecular weight waxes such as amide or ester waxes reduce the problem only to a certain extent. At higher printing energies, a white line is still observed.

SUMMARY OF THE INVENTION

It is therefore an object of the present invention to provide a dye-donor element for use according to thermal dye transfer methods, said element having favourable slipping properties and nevertheless causing no substantial contamination of the thermal printing head.

It is a further object of the present invention to provide a dye-donor element for use according to thermal dye transfer methods exhibiting no white lines at high printing energies.

Further objects will become apparent from the description hereinafter.

According to the present invention a dye-donor element for use according to thermal dye transfer methods is provided, said element comprising a support having on the frontside a dye layer containing a thermally transferable dye and on the back side (i) a heat-resistant layer comprising a binder and (ii) optionally a topcoat layer, said heat-resistant layer and/or said topcoat layer comprising a polysiloxane based lubricant and wherein at least one layer on said back side comprises a salt of a fatty acid.

The present invention further provides a method of forming an image by:

image-wise heating by means of a thermal head having a plurality of heating elements a dye-donor element as defined above and causing transfer of image-wise heated dye to a receiver sheet.

DETAILED DESCRIPTION OF THE INVENTION

Figure 1:
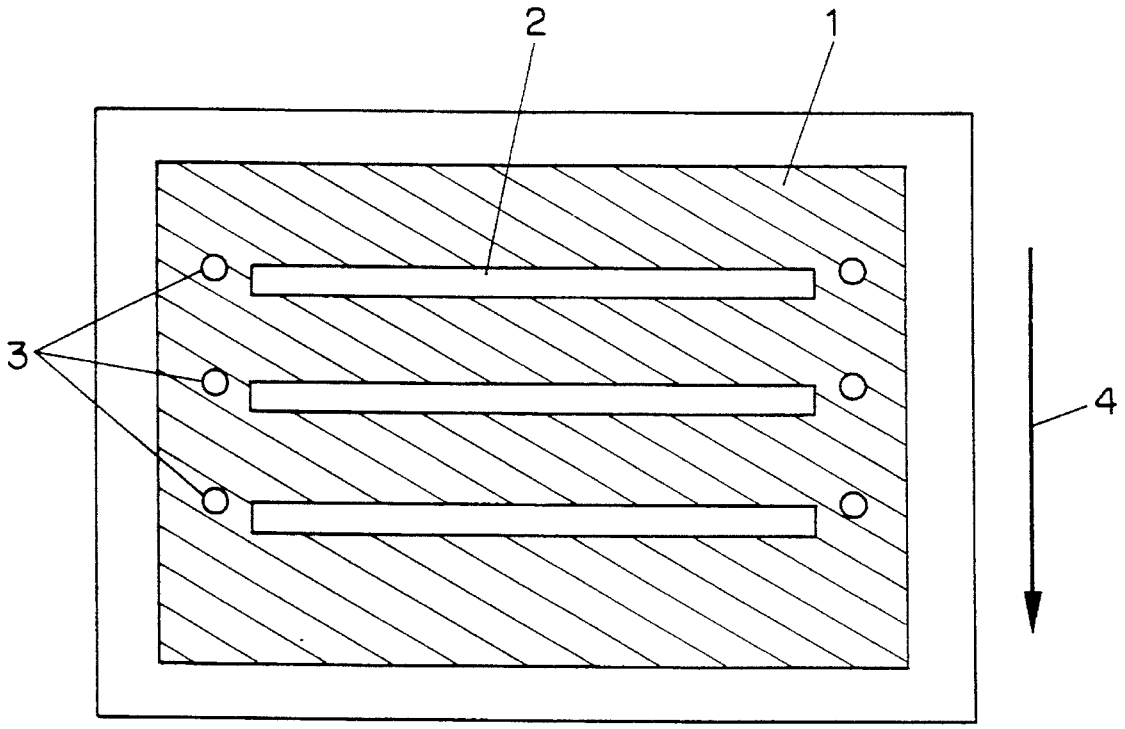
FIG. 1 shows a schematic representation of a printed images containing white lines (2) parallel to the line of the heater elements of the thermal head in a flat field of high density (1).

The polysiloxane based lubricants used in the present invention are preferably based on polydialkylsiloxane e.g. polydimethylsiloxane, polydiarylsiloxane or polyalkylarylsiloxane. These polysiloxanes can be functionalized with amino, hydroxy, acetoxy and other groups. Modified polysiloxanes such as polyalkylene oxide-modified polydimethylsiloxanes such as Byk 320, Byk 307, and Byk 330 (Byk Cera) Tegoglide 440 and Tegoglide 410 (Goldschmidt) are especially preferred.

Salts of fatty acids for use in accordance with the present invention are salts derived from fatty acids having an alkyl, alkenyl or alkynyl chain of more than 8 carbon atoms and which chains may be branched or linear. It is highly preferred to use salts of stearic acid. Although alkali metal salts can be used, multivalent counter ions are preferred. Especially preferred salts are calcium stearate, magnesium stearate, aluminium stearate and zinc stearate. Among them, zinc stearate is highly preferred.

It is also possible to use a mixture of fatty acid salts in accordance with the present invention e.g. a mixture of zinc stearate, calcium stearate and/or magnesium stearate may be used. The fatty acid salts in connection with the present invention may also be used in admixture with their corresponding acids or with the corresponding ester or amides derived from the fatty acid. For example the fatty acid salt may be used in admixture with a methyl ester or glycerine ester derived from the fatty acid, more in particular there can be used a combination of e.g. zinc stearate with methylstearate and/or glycerinetristearate.

These salts of fatty acids are usually insoluble in the coating liquid for application to the dye-donor element. Dispersion can be made by precipitation or by ball-milling. In case a dispersion is used, the average particle size is preferably less than 10μ. A particle size between 1 and 5μ is highly preferred, since these particles further have an anti-sticking function when the donor ribbon is stored in rolled form.

The fatty acid salt can be added to any layer of the backside of the dye donor element e.g. a primer layer, heat-resistant layer or top-layer. Preferably the fatty acid is used in the heat-resistant layer.

The amount of fatty acid salts used in connection with the present invention is preferably between 2 and 200 mg, more preferably between 10 and 50 mg per square meter.

The amount of polysiloxane is preferably between 2 and 200 mg/m$^2$ and more preferably between 10 and 50 mg/m$^2$.

A combination of a polyether modified polysiloxane with a zinc stearate is highly preferred in the present invention.

As mentioned above, both components can be coated in a single layer, with or without the use of a binder, or can be casted in a separate layer. It is highly preferred to cast the salt of a fatty acid in the heat resistant layer (e.g. as a dispersion) and the polysiloxane based lubricant in a separate topcoat. This separate topcoat is preferably casted from a non-solvent for the heat-resistant layer.

Inorganic particles such as salts derived from silica such as e.g. talc, clay, china clay, mica, chlorite, silica, or carbonates such as calcium carbonate, magnesium carbonate or calcium magnesium carbonate (dolomite) can be further added to the heat resistant layer.

It is highly preferred to add mixtures of particles to the heat resistant layer having a Mohs hardness below 2.7 and particles having a Mohs hardness above, 2.7 such as mentioned in EP-A-93201642.1.

A mixture of talc and dolomite particles is highly preferred.

The binder for the heat-resistant layer can be a cured binder or a polymeric thermoplast.

A cured binder can be produced by a chemical reaction as described in e.g. EP 153,880 and EP 194,106, or by the influence of moisture as described in e.g. European Patent Application No. 91202098.9, or by irradiation of a radiation-curable composition as described in e.g. EP 314,348 and EP 458,538.

Thanks to the fact that the coating procedure of polymeric thermoplasts is very convenient, they are preferably used as binder for the heat-resistant layer. Preferred polymeric thermoplasts are those having a glass transition temperature above 100° C.; these thermoplasts are suited for use as binder in the heat-resistant layer, because they are dimensionally stable at higher temperatures. Polymers having a glass transition temperature above 170° C. are especially preferred. Even more preferred polymeric thermoplasts are those that are soluble in ecologically acceptable solvents such as ketones (e.g. ethyl methyl ketone and acetone) and alcohols (e.g. isopropanol).

Representatives of polymeric thermoplasts that are suited for use as binder in the heat-resistant layer are e.g. poly-(styrene-co-acrylonitrile), polycarbonated derived from bisphenol A, polyvinyl butyral, polyvinyl acetal, ethyl cellulose, cellulose acetate butyrate, cellulose acetate propionate, and polyparabanic acid.

Especially preferred polymeric thermoplasts are the polycarbonates derived from a bis-(hydroxyphenyl)-cycloalkane corresponding to general formula (I) :

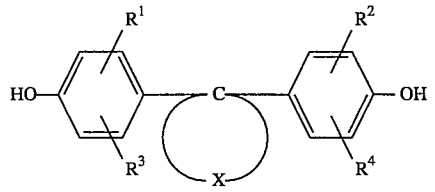

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group.

These polycarbonates provide a better heat-stability to the heat-resistant layer than conventional polymeric thermoplasts. They also have higher glass transition temperatures (Tg), typically in the range of about 180° C. to about 260° C., than polycarbonates derived from bisphenol A (Tg of about 150° C.). The polycarbonates can be homopolycarbonates as well as copolycarbonates.

Preferably one to two carbon atoms of the group of atoms represented by X, more preferably only one carbon atom of that group, carry (carries) two $C_1$–$C_6$ alkyl groups on the same carbon atom. A preferred alkyl group is methyl. Preferably, the carbon atoms of the group of atoms represented by X, which stand in β-position to the diphenyl-substituted carbon atom, do not carry two $C_1$–$C_6$ alkyl groups. Substitution with two $C_1$–$C_6$ alkyl groups on the carbon atom(s) in β-position to the diphenyl-substituted carbon atom is preferred.

Preferred examples of bis-(hydroxyphenyl)-cycloalkanes corresponding to general formula I, which can be employed for preparing the polycarbonates that can be used according to the present invention are those comprising 5- or 6-membered alicyclic rings. Examples of such bis-(hydroxyphenyl)-cycloalkanes are those corresponding to the following structural formulae II to IV.

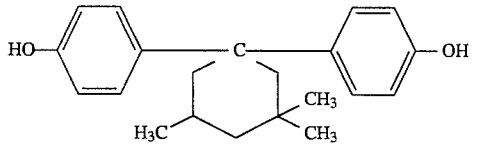

(II)

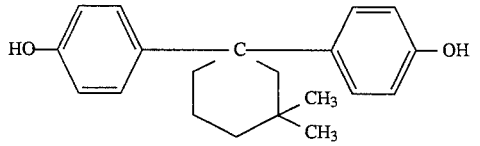

(III)

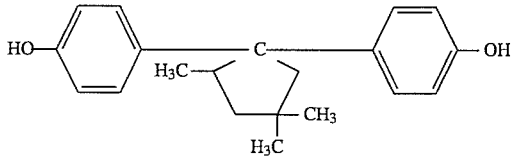

(IV)

A particularly preferred bis-(hydroxyphenyl)-cycloalkane is 1,1 -bis-(4-hydroxyphenyl)-3,3,5-trimethylcyclohexane (formula (II)).

Incorporation of bisphenol A in the polycarbonate for use according to the present invention reduces the brittleness of the polycarbonate.

If in the preparation of polycarbonates according to the present invention the bis-(hydroxyphenyl)-cycloalkanes corresponding to general formula (I) are used together with another bisphenol such as bisphenol A, the amount of bis-(hydroxyphenyl)-cycloalkanes corresponding to general formula (I) in the mixture is preferably at least 10 mol %, more preferably at least 25 mol %.

According to another preferred embodiment the polycarbonate for use according to the present invention is derived from 100 mol % of bis-(hydroxyphenyl)-cycloalkanes corresponding to the above general formula (I).

Examples of polycarbonates that can be used advantageously in accordance with the present invention are i.a.:

PC1 Homopolycarbonate having the following structure:

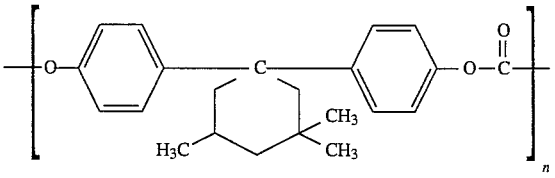

wherein n has a value giving a relative viscosity of 1.295 (measured in a 0.5% by weight solution in dichloromethane)

PC2 Homopolycarbonate having the same structure as PC1 but having a relative viscosity of 2.2

PC3 Copolycarbonate having the following structure:

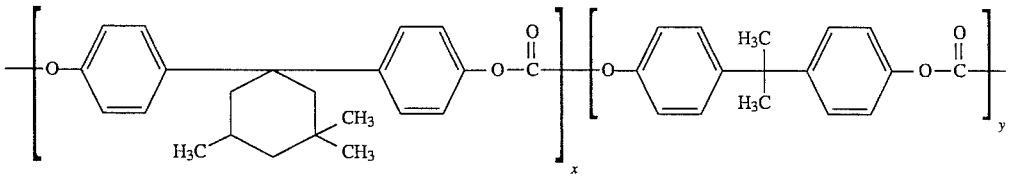

wherein x=55 mol % and y=45 mol %; PC3 has a relative viscosity of 1.295.

The binder of the heat-resistant layer of the dye-donor element according to the present invention may also consist of a mixture of binders.

The heat-resistant layer of the dye-donor element according to the present invention may in addition to said inorganic particles and the binder comprise minor amounts of such other agents like surface-active agents, liquid lubricants or solid lubricants.

A preferred heat-resistant layer of the dye-donor element according to the present invention is formed preferably by adding the polymeric thermoplastic binder or binder mixture, a salt of a fatty acid, inorganic particles, and other optional components to a suitable solvent or solvent mixture, dissolving or dispersing the ingredients to form a coating composition, applying said coating composition to a support, which may have been provided first with an adhesive or subbing layer, and drying the resulting layer.

The heat-resistant layer of the dye-donor element may be coated on the support or printed thereon by a printing technique such as a gravure printing.

The heat-resistant layer thus formed has a thickness of about 0.1 to 3 μm, preferably 0.3 to 1.5 μm.

Although the above-mentioned ingredients of the heat-resistant layer can be incorporated in one single layer, it is sometimes preferred to incorporate at least part of the additives such as lubricants and/or surface-active agents in a separate topcoat on top of the heat-resistant layer. As a result the lubricants and/or surface-active agents are in direct contact with the thermal printing head and thus lead to improved slipping properties of the the dye-donor element.

As mentioned above, the use of a separate topcoat comprising at least a part of said polysiloxane based lubricant is highly preferred.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, European Patent Application No. 92200907.1, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238, and U.S. Pat. No. 4,965,241.

Any dye can be used in the dye layer of the dye-donor element of the present invention provided it is transferable to the receiver sheet by the action of heat. Examples of suitable dyes have been described in e.g. EP 432,829, EP 400,706, European Patent Application No. 90203014.7, European Patent Application No. 91200218.5, European Patent Application No. 91200791.1, and in the references mentioned therein.

The amount ratio of dye or dye mixture to binder generally ranges from 9:1 and 1:3 by weight, preferably from 3:1 and 1:2 by weight.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copoly(styrene-co-acrylonitrile); polysulfones; polyphenylene oxide; organosilicones, such as polysiloxans; epoxy resins and natural resins, such as gum arabic. Preferably, the binder for the dye layer of the present invention comprises poly(styrene-co-acrylonitrile) or a mixture of poly(styrene-co-acrylonitrile) and a toluenesulphonamide condensation product.

The dye layer may also contain other additives such as i.a. thermal solvents, stabilizers, curing agents, preservatives, organic or inorganic fine particles, dispersing agents, antistatic agents, defoaming agents, and viscosity-controlling agents, these and other ingredients being described more fully in EP 133,011, EP 133,012, EP 111,004, and EP 279,467.

Addition of beads of polyolefin waxes or amid waxes, and/or of polymethylsilylsesquioxan particles, as described in European Patent Application No. 92203496.2, to the dye layer, said beads and/or particles protruding from the surface of said layer, is especially preferred.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive of subbing layer, if desired. Examples of suitable subbing layers have been described in e.g. EP 433,496, EP 311,841, EP 268,179, U.S. Pat. Nos. 4,727,057, and 4,695,288.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropylacrylamide, butyl methacrylate-grafted gelatin, ethyl methacrylate-grafted gelatin, ethyl acrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye layer so that the need for a separate adhesive or subbing layer is avoided. These particular hydrophilic polymers used in a single layer in the dye-donor element thus perform a dual function, hence are referred to as dye-barrier/subbing layers.

The support for the receiver sheet that is used with the dye-donor element may be a transparent film of e.g. polyethylene terephthalate, a polyether sulfone, a polyimide, a cellulose ester, or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polyvinyl chloride, polystyrene-co-arcylonitrile, polycaprolactone, or mixtures thereof. The dye-image receiving layer may also comprise a heat-cured product of poly(vinyl chloride-co-vinyl acetate-co-vinyl alcohol) and polyisocyanate. Suitable dye-image-receiving layers have been described in e.g. EP 133,011, EP 133,012, EP 144,247, EP 227,094, and EP 228,066.

In order to improve the light resistance and other stabilities of recorded images, UV absorbers, singlet oxygen quenchers such as HALS-compounds (Hindered Amine Light Stabilizers) and/or antioxidants may be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be applied in a separate layer on at least part of the dye layer or of the dye-image-receiving layer. Suitable releasing agents are solid waxes, fluorine- or phosphate-containing surfactants and silicone oils. Suitable releasing agents have been described in e.g. EP 133,012, JP 85/19,138, and EP 227,092.

A subbing layer can be provided between the dye-receiving layer and the support. Suitable subbing layers are based on vinylidenechloride copolymers, aromatic copolyesters and polystyrene sulphonic acid. Hydrophilic layers in between the subbing layer and the dye receiving layer can be applied in order to enhance the recyclability of the support. This hydrophilic layer comprises usually a water-soluble binder such as gelatin, polyvinylalcohol, hydroxypropylcellulose, hydroxyethyl cellulose or polystyrenesulphonic acid (or sodium salt), or a mixture thereof, with or without an anionic, a kationic, a nonionic or a zwitter ionic surfactant. A particular useful combination of a subbing layer, a hydrophilic layer and a dye-receiving layer is

- a subbing layer comprising polystyrene sulphonic acid
- a hydrophilic layer comprising hydroxyethylcellulose, and polystyrenesulphonic acid or a butadiene copolymer and an anionic surfactant.
- a dye receiving layer based on a crosslinked vinylchloride based copolymer.

The dye-donor elements according to the invention are used to form a dye transfer image, which process comprises placing the dye layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

Preferably, the average printing power applied by means of a thermal printing head during the image-wise heating of the dye-donor element is higher than 4.5 W/mm$^2$.

When the image-wise heating process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

The following example illustrates the invention in more detail without, however, limiting the scope thereof. All parts are by weight unless otherwise specified.

EXAMPLE

A series of dye-donor elements for use according to thermal dye sublimation transfer were prepared as follows.

Polyethylene terephthalate film having a thickness of 5.7 μm was provided on both sides with a subbing layer from a solution of copolyester comprising isophthalic acid units/terephthalic acid units/ethylene glycol units/neopentyl glycol units/adipic acid units/glycerol units in ethyl methyl ketone.

A solution comprising 9% by weight of dye A, 2% by weight of dye B, and 10% by weight of poly(styrene-co-acrylonitrile) as binder in ethyl methyl ketone as solvent was prepared.

From the resulting solution a layer having a wet thickness of 10 μm was coated on the subbed polyethylene terephthalate film. The resulting dye layer was dried by evaporation of the solvent.

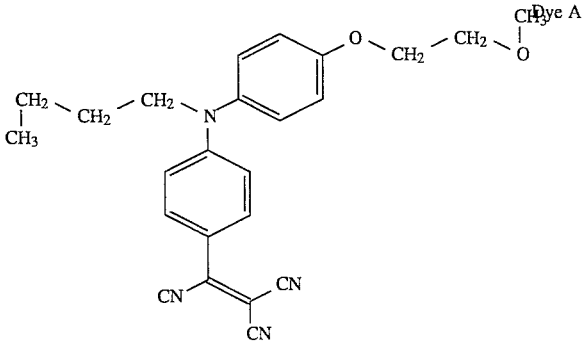

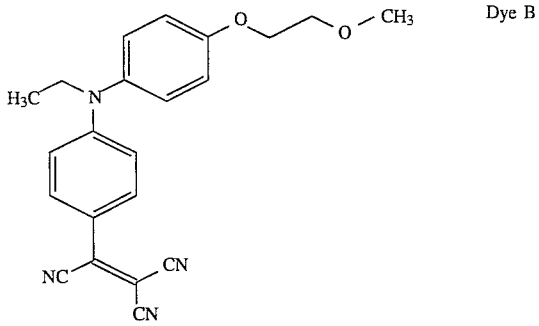

A heat-resistant layer having a wet thickness of 10 μm was coated on the subbed back of the polyethylene terephthalate film from a solution in ethyl methyl ketone containing a polycarbonate binder PC1 (13% by weight) and, 0.5% by weight talc (Nippon Talc P3), 0.1% Microdol Super (Norwegian Talc) and a salt of a fatty acid, the nature and amount of which are indicated below in Table 1. The salt of the fatty acids was added to the coating solution as a dispersion in butanon, prepared by ball-milling overnight 5% polycarbonate PC1 and 20% of said salt of the fatty acid.

The side of the donor elements that showed the heat-resistant layer was coated with a solution forming a topcoat, said solution being a 0.5% by weight solution of Tegoglide 410 (commercially available from Goldschmidt) in isopropanol (topcoat I in table I) or a 0.5% by weight solution of Byk 320 (commercially available from Byk-Ceras) in isopropylacetate (topcoat II in table I) or a 0.5% by weight solution of Tegoglide 410 mixed with 0.5% dispersed zinc stearate (topcoat III in table I) or a 0.5% by weight solution of Tegoglide 410 mixed with 0.5% dispersed stearic acid (topcoat IV in table I).

Receiver sheets were prepared by coating a polyethylene terephthalate film support having a thickness of 175 μm with a dye-image-receiving layer from a solution in ethyl methyl ketone of 3.6 g/m$^2$ of poly(vinyl chloride/co-vinyl acetate/co-vinyl alcohol) (Vinylitc VAGD supplied by Union Carbide), 0.336 g/m$^2$ of diisocyanate (Desmodur VL supplied by Bayer AG), and 0.2 g/m$^2$ of hydroxy-modified polydimethylsiloxan (Tegomer H SI 2111 supplied by Goldschmidt).

Each dye-donor element was printed in combination with a receiver sheet in a printer set-up using a Kyocera thermal printing head, Type KGT-219-12MP4-75PM at an average power of 60 mW per dot (total amount of energy applied to one resistor element divided by the total line time, 80 mW with a duty cycle of 75%). The surface of the heater element measured 68 by 152 mm. Consequently, the average printing power applied to the heater elements was 5.8 W/mm$^2$. A high density flat field (1) was printed with white lines (2) parallel to the line of heater elements (FIG. 1). The print direction (4) was as shown in FIG. 1.

The print was inspected visually in the inspection zones (3) marked in FIG. 1. In good examples, no white line was observed in the inspected zone (good in table 1). When a white line could be seen in the inspected zone, a bad quotation was given in table 1. After printing 100 prints, the thermal printing head was disconnected from the printer and inspected under an optical microscope (Leitz microscope: enlargement 100×) to trace any contamination of the resistors of the thermal printing head. The following levels of contamination were attributable: excellent (no contamination at all), good (hardly perceptible contamination), moderate (clearly visible contamination), and bad (extensive contamination all over the electrode surfaces).

In Table 1 hereinafter (E) stands for excellent, (G) for good, (M) for moderate, and (B) for bad. The amounts of the salts of fatty acids are indicated in % by weight calculated on the total weight of the coating solution (solvent was added up to 100%). The results obtained are listed in Table 1.

TABLE 1

| | Type | Conc. | Top-coat | White lines | Contamination |
|---|---|---|---|---|---|
| COMP 1 | — | — | I | B | E |
| COMP 2 | Zinc stearate | 0.5% | — | B | * |
| COMP 3 | Polyethylene wax Ceracol 90 (Byk-Cera) | 0.5% | I | G | B |
| COMP 4 | Paraffine | 0.5% | I | B | * |
| COMP 5 | Paraffine | 1% | I | B | * |
| COMP 6 | Glycerine-tristearate | 0.5% | I | B | * |
| COMP 7 | Stearamide | 0.5% | I | B | * |
| COMP 8 | Carnaubawax | 0.5% | I | | |
| COMP 9 | — | — | II | B | * |
| COMP 10 | — | — | IV | B | * |
| INV 1 | Zinc stearate | 0.5% | I | G | E |

TABLE 1-continued

| | Type | Conc. | Top-coat | White lines | Contamination |
|---|---|---|---|---|---|
| INV 2 | Zinc stearate | 1% | I | G | E |
| INV 3 | Zinc stearate | 0.5% | II | G | E |
| INV 4 | Mg stearate | 0.5% | I | G | E |
| INV 5 | — | — | III | G | E |

*not evaluated

From table I, it is clear that the heat-resistant layers of the present invention are superior to the heat-resistant layers of the prior art. It is also demonstrated that the salt of the fatty acid can be-added to the topcoat instead of to the heat-resistant layer. (example INV 5).

We claim:

1. A dye-donor element for use according to thermal dye transfer methods comprising a support having on the front side a dye layer containing a thermally transferable dye and on the back side (i) a heat-resistant layer comprising a binder and (ii) optionally a topcoat layer, said heat-resistant layer and/or said topcoat layer comprising a polysiloxane based lubricant and wherein at least one layer on said back side comprises fatty acid salt particles having an average particle size less than 10 μm.

2. Dye-donor element according to claim 1, wherein said polysiloxane based lubricant is a polyether modified polysiloxane.

3. Dye-donor element according to claim 2, wherein said salt of a fatty acid is a salt of stearic acid.

4. Dye-donor element according to claim 1, wherein said salt of a fatty acid is zinc stearate.

5. A dye-donor element according to claim 1, wherein said binder is a polymeric thermoplast.

6. A dye-donor element according to claim 5, wherein said binder is a polycarbonate derived from a bis-(hydroxyphenyl)-cycloalkane corresponding to general formula (I): wherein:

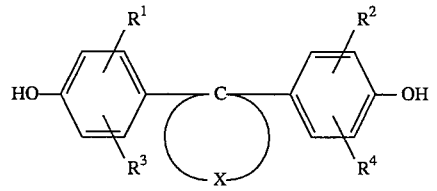

(I)

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group.

7. Dye-donor element according to claim 1, wherein said heat resistant layer further comprises inorganic particles.

8. Dye-donor element according to claim 7, wherein said inorganic particles substantially consist of a mixture of a first type of inorganic particles, which are silicate particles having a Mohs hardness below 2.7, and of a second type of inorganic particles, which are silicate or carbonate particles having a Mohs hardness of at least 2.7 in a ratio by weight of said first type to said second type of inorganic particles comprised between 20:1 and 1:2.

9. A method of forming an image comprising the steps of image-wise heating by means of a thermal head having a plurality of heating elements a dye-donor element as defined in claim 1 and causing transfer of image-wise heated dye to a receiver sheet.

10. A method according to claim 9 wherein during said image-wise heating, a maximum average power exceeding 4.5 $W/mm^2$ is applied to said dye-donor element.

11. Dye-donor element according to claim 1, wherein said salt of a fatty acid is a salt of stearic acid.

12. Dye-donor element according to claim 1, wherein said heat resistant layer further comprises inorganic particles.

13. Dye-donor element according to claim 1, wherein said fatty acid salt particles have an average particle size between 1 μm and 5 μm.

* * * * *

UNITED STATES PATENT AND TRADEMARK OFFICE

CERTIFICATE OF CORRECTION

PATENT NO. : 5,474,970

DATED : December 12, 1995

INVENTOR(S) : Defieuw et al.

It is certified that error appears in the above-identified patent and that said Letters Patent is hereby corrected as shown below:

Column 5, line 15, "ß-position" should read --α-position--;

Column 7, line 66, "pyryolidone" should read --pyrrolidone--.

Signed and Sealed this

Eleventh Day of June, 1996

Bruce Lehman

*Attest:*

BRUCE LEHMAN

*Attesting Officer*

*Commissioner of Patents and Trademarks*